US008395323B2

(12) United States Patent
Wendt et al.

(10) Patent No.: US 8,395,323 B2
(45) Date of Patent: Mar. 12, 2013

(54) RELIABLE LIGHTING SYSTEM

(75) Inventors: Matthias Wendt, Wuerselen (DE); Theodore James Letavic, Putnam Valley, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 514 days.

(21) Appl. No.: 12/599,702

(22) PCT Filed: May 9, 2008

(86) PCT No.: PCT/IB2008/051845

§ 371 (c)(1), (2), (4) Date: Nov. 11, 2009

(87) PCT Pub. No.: WO2008/139400

PCT Pub. Date: Nov. 20, 2008

(65) Prior Publication Data

US 2010/0301756 A1 Dec. 2, 2010

Related U.S. Application Data

(60) Provisional application No. 60/917,962, filed on May 15, 2007.

(51) Int. Cl.
*H05B 37/00* (2006.01)

(52) U.S. Cl. ..... 315/149; 315/159; 315/307

(58) Field of Classification Search ..... 315/291, 315/307, 308, 149, 156, 159, 157, 158
See application file for complete search history.

(56) References Cited

U.S. PATENT DOCUMENTS

| | | | | |
|---|---|---|---|---|
| 5,896,318 | A | 4/1999 | Asada et al. | |
| 5,938,772 | A * | 8/1999 | Welch | 713/320 |
| 6,490,512 | B1 | 12/2002 | Niggemann | |
| 6,636,937 | B2 | 10/2003 | Peter | |
| 6,842,375 | B1 | 1/2005 | Raszka | |
| 2005/0157515 | A1 | 7/2005 | Chen et al. | |
| 2005/0249105 | A1 | 11/2005 | Kahlman et al. | |
| 2006/0044293 | A1 * | 3/2006 | Clewett et al. | 345/204 |

FOREIGN PATENT DOCUMENTS

| | | | |
|---|---|---|---|
| JP | 02257497 | A | 10/1990 |
| JP | 09068096 | A | 3/1997 |

* cited by examiner

*Primary Examiner* — David H Vu
(74) *Attorney, Agent, or Firm* — Mark L. Beloborodov

(57) ABSTRACT

A lighting system (1) and its applications are described that are suitable especially in the realm of lighting systems (1) with high power light emitting diodes (LEDs). The lighting system (1) comprises a control circuit (3) with a memory device (4) and a refresh circuit (10), and the refresh circuit (10) is adapted to prevent data loss of the memory device (4) due to the reduction of the retention time of the memory device (4) caused by the high operation temperature of the LEDs.

6 Claims, 2 Drawing Sheets

RELIABLE LIGHTING SYSTEM

FIELD OF THE INVENTION

The current invention is related to lighting systems, the use of lighting systems and a method of driving lighting systems.

BACKGROUND OF THE INVENTION

In US 2005/0157515 A1, a light emitting diode light source is disclosed having a printed circuit board with a plurality of side faces, a plurality of RGB LED units arranged on one side face of the printed circuit board and each unit having a red LED, a green LED and a blue LED, and at least one control unit connected to each LED in the RGB LED units and controlling a driving current to the LED. Each of the RGB LED units emits white light with a stable color temperature. The control unit has a memory for storing a driving current data for each LED. Whereas, it is described that due to variations in the LED fabrication process a calibration process can be executed on each LED, and the characteristic data assembled during the calibration process can be stored in the memory of the control unit in order to control the color temperature of the LEDs, the problems caused by the LEDs themselves during operation are not recognized. Especially the heat produced by the LEDs strongly influences the operation of the LED.

SUMMARY OF THE INVENTION

It is an objective of the current invention to provide a lighting system with reliable operation throughout the lifetime of the light emitting device.

The objective is achieved by means of a lighting system comprising at least one light emitting device, a control circuit with a memory device and a refresh circuit, and the refresh circuit is adapted to prevent data loss of the memory device.

The heat produced by one or more light emitting devices such as e.g. a light emitting diode (LED) may not only influence the light output of the LED itself, but it also influences the memory device storing the data for controlling the lighting system by means of the control circuit. In future lighting systems comprising light emitting devices like halogen or HID lamps, also memory devices for e.g. wireless communication (for example according to the ZigBee protocol) may be needed. Identification data such as the communication address of the light emitting device may get lost during operation of the lighting system due to the heat produced by the light emitting device.

Today's memory devices, such as e.g. μCs OTP and EEPROM cells, are used in order to keep the information on an electrically isolated electroconductive layer by means of electrical charge. The retention time, that means the time the information is kept by means of the memory device without data loss of such μCs OTP and EEPROM cells, is around 20 years at 85° C. but the retention time decreases about exponentially with increasing temperature. Especially the combination of high power LEDs with a high LED-temperature on the one hand and a long lifetime of 50,000 h and more on the other hand enhances the problem. The high LED-temperature of e.g. 120° C. and more may result in a retention time of the memory device of less than the lifetime of the LEDs, causing unreliable operation of the lighting system. The combination of the control circuit including the memory device with the refresh circuit prevents that problem. The refresh circuit refreshes the data stored by means of the memory device by restoring e.g. the original electrical charge provided to μCs OTP or EEPROM cells. Data, once stored by means of the memory device, can be maintained for the whole lifetime of the lighting system. The advantage of the refresh circuit in a lighting system is not limited to memory devices based on electrical charge, as μCs OTP and EEPROM cells are. The retention time of memory devices based on the magnetization of e.g. ferroelectric materials (e.g. Magnetoresistive Random Access Memories) or even optical memories may also depend on the operation temperature of the memory devices. The lighting system may further be provided with a system to control the operation temperature of the light emitting device such as for example a LED. Further, many of the constant memory technologies do have a limited number of write cycles that can be reliably carried out. Memory refresh cycles should only be initiated when required. It is hence a further objective of the invention to keep the rewrites to a minimum.

In a further embodiment of the current invention, the lighting system further comprises a memory status sensor, and the memory status sensor is adapted to trigger the refresh circuit in dependence on the status of the memory device. The memory status sensor is used to estimate or determine the moment in time where the data stored by means of the memory device gets lost, that means that e.g. the charge stored in a μCs OTP or EEPROM cell decreases below a certain threshold value necessary to differentiate between a binary 0 and a binary 1. The memory status sensor may be a temperature sensor measuring the operation temperature of the memory device. The measurement data of the temperature sensor can be used to estimate the retention time of the memory device, using the previously determined temperature dependence of the retention time of a certain memory device. The data stored by means of the memory device is refreshed or restored depending on the measurement results of the temperature sensor. In an alternative approach, the memory status sensor may be a charge sensor recurrently measuring the electrical charge of e.g. a μCs OTP or EEPROM cell. Comparing the voltage across a test μCs OTP or EEPROM cell with a reference voltage can be e.g. one special embodiment of the memory status sensor. The μCs OTP or EEPROM cell or cells used for this measurement can be one or more memory cells used for storing the data or one or more dedicated test memory cells only used for measuring the status (charge) of the memory device. In another approach, the test memory cells are intentionally made worse than the main memory cells e.g. by using less area, so that they are more prone to memory loss over time. The measurement is done in a differential way. So, the test cell A is charged with a "1" and the test cell B with a "0". Differential operational amplifier means are used to measure the charge difference between the two cells, and when a certain minimal difference is not found anymore a refresh cycle is initiated. In the case of memory devices based on the magnetization of e.g. ferroelectric materials, the magnetization of a test memory cell can be measured e.g. by recurrently measuring the electrical resistance of the test memory cell. Phase changes caused by high operation temperatures of optical memory devices can be measured by reflectivity measurements of a test memory cell.

In another embodiment of the current invention, the lighting system further comprises a system status indicator and the system status indicator is adapted to trigger the refresh circuit in dependence on the status of the lighting system. Depending on the average operation conditions in a certain light emitting device, such as e.g. a LED, it is also possible to determine an absolute lower limit of the retention time. The data stored by means of the memory device may then be restored after a predetermined operation time, being smaller than the retention time, or e.g. recurrently after switching on the LED lighting device.

According to a further embodiment of the current invention, the lighting system further comprises at least one light sensor, the light sensor is adapted to measure the light output of the lighting system and the refresh circuit is further adapted to modify data saved in the memory device in dependence on the measurements of the light sensor. During the lifetime of a lighting system, the color point and/or brightness, in dependence on operation conditions (applied current, temperature etc.), of one or more light emitting devices and especially if LEDs are used as light emitting devices may change due to aging of materials. Consequently, the calibration data stored in the memory device at the beginning of the lifetime of the LED(s) in order to guarantee a defined light output of the LED lighting device has to be updated. The combination of the refresh circuit and a light sensor measuring the light output of the lighting system or light sensors measuring the light output of individual LEDs, enables adapting the data stored in the memory device, using the measurement results of the light sensor. This can e.g. be done by means of a calibration sequence performed after a certain operation time. During the calibration procedure, the light output of either the lighting system or e.g. individual LEDs is measured in for example different operation conditions, resulting in a data set that may be used to adapt the data previously stored in the memory device during restoring the data. In addition, the light sensor can be used to initiate restoring of the data stored in the memory device if a defined deviation of the light output (brightness and/or color) of either the lighting system or e.g. individual LEDs in comparison to a reference light output is determined. If such a deviation is measured, the calibration procedure mentioned above may be started and the data previously stored in the memory device may be adapted during subsequently restoring the data. Also combinations of the light sensor and the memory status sensor or system status indicator can be used to guarantee reliable operation of the lighting system.

A lighting system according to the current invention can be used in

Office lighting systems
Household application systems
Shop lighting systems,
Home lighting systems,
Accent lighting systems,
Spot lighting systems,
Theatre lighting systems,
Fibre-optics application systems,
Projection systems,
Self-lit display systems,
Pixelated display systems,
Segmented display systems,
Warning sign systems,
Medical lighting application systems,
Indicator sign systems, and
Decorative lighting systems
Portable systems
Automotive applications
Green house lighting systems
Sensor applications It is a further objective of the current invention to provide a reliable method of driving a lighting system.

This objective is achieved by means of a method of driving a lighting system comprising at least one light emitting device, a control circuit with a memory device and a refresh circuit, the method comprising the steps of:

storing data in the memory device;

controlling the lighting system by means of the control circuit and refreshing the data stored by means of the memory device by means of the refresh circuit. Refreshing the data means restoring the originally or previously saved data, which data to be restored may by actualized. The actualization of the data to be restored can e.g. be related to a previously determined change of the quality of light output (e.g. brightness, color point) of the lighting system or single light emitting devices, such as e.g. LEDs, due to aging of materials in dependence on operation time and/or operation conditions, and the data describing the change of the quality of light output may also be stored by means of the memory device. The refreshing of the data stored in the memory device can be triggered by means of the operation time of the light emitting device, operation conditions such as e.g. the temperature of the memory device during the operation of the light emitting device, the status of the data stored by means of the memory device determined by means of a memory status sensor and/or a light sensor as described above. The light sensor can further be used to actualize the data to be restored by means of the refresh circuit, depending on the actual light output of the lighting system or the single light emitting devices.

BRIEF DESCRIPTION OF THE DRAWINGS

The present invention will be explained in greater detail with reference to the Figures, in which the same reference signs indicate similar parts, and in which.

DETAILED DESCRIPTION OF EMBODIMENTS

Figure 1:
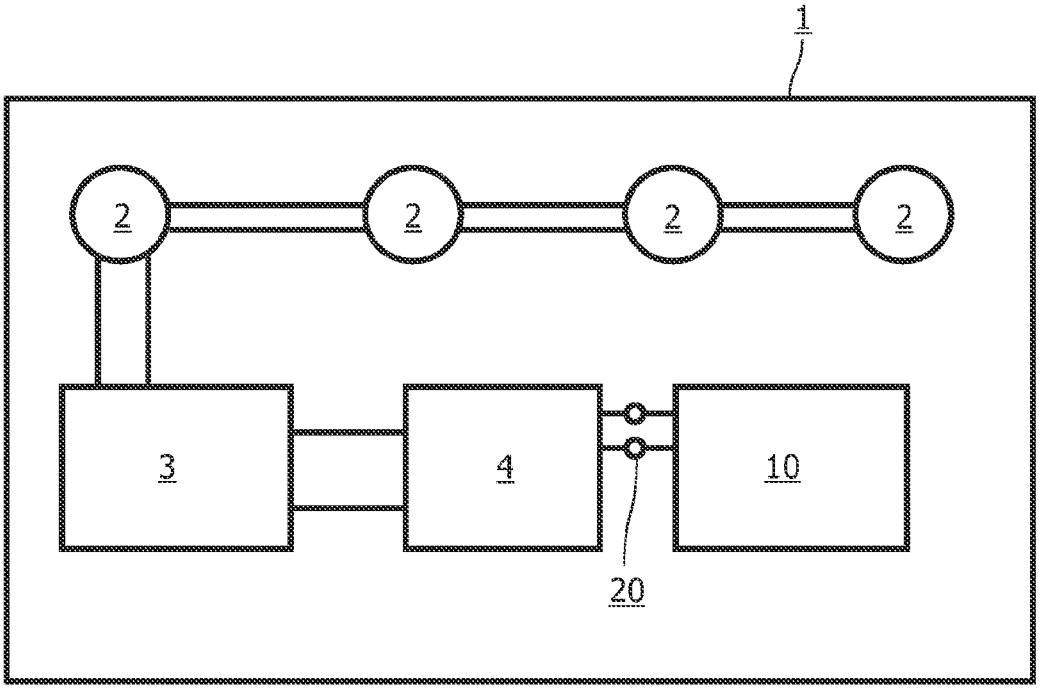
FIG. 1 shows a principal sketch of a first embodiment of a lighting system according to the invention.
Figure 2:
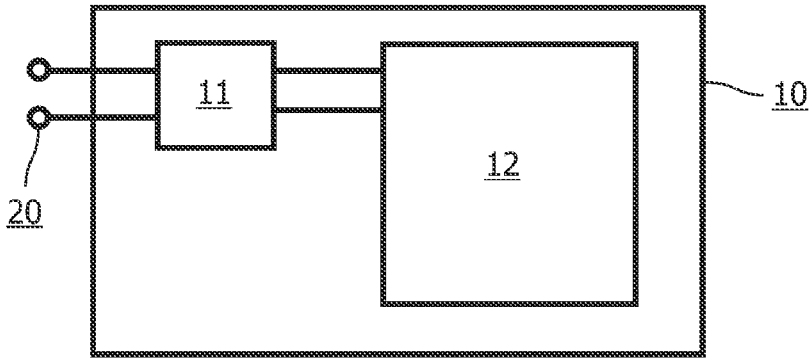
FIG. 2 shows a principal sketch of one embodiment of a refresh circuit according to the current invention.

The principal sketch of a lighting system 1 depicted in FIG. 1 shows four LEDs 2. The four LEDs 2 are series-connected to the control circuit 3. The control circuit 3 controls the light output e.g. brightness or if colored LEDs are used the color of the single LEDs. The control circuit 3 is connected to a memory device 4 being e.g. an EEPROM where the data needed to control the LEDs 2 is stored. The data stored by means of the memory device 4 comprises e.g. the calibration data and the characteristic lines of the single LEDs 2. The memory device 4 is further connected via an interface 20 to a refresh circuit 10. The refresh circuit 10 comprises a controller 10 and a buffer memory 12 as shown in FIG. 2. After a predetermined operation time t1, being shorter than the retention time of the memory device 4 of the lighting system 1, the controller 11 copies the data stored by means of the memory device 4 to the buffer memory 12 in a first step. In a subsequent step the controller 11 overwrites the data stored by means of the memory device 4 with the data stored in the buffer memory 12. After restoring the data, the controller sets the operation time of the lighting system back to zero. The refresh circuit 10 guarantees that the data stored by means of the memory device 4 is preserved throughout the lifetime of the lighting system 1.

Figure 3:
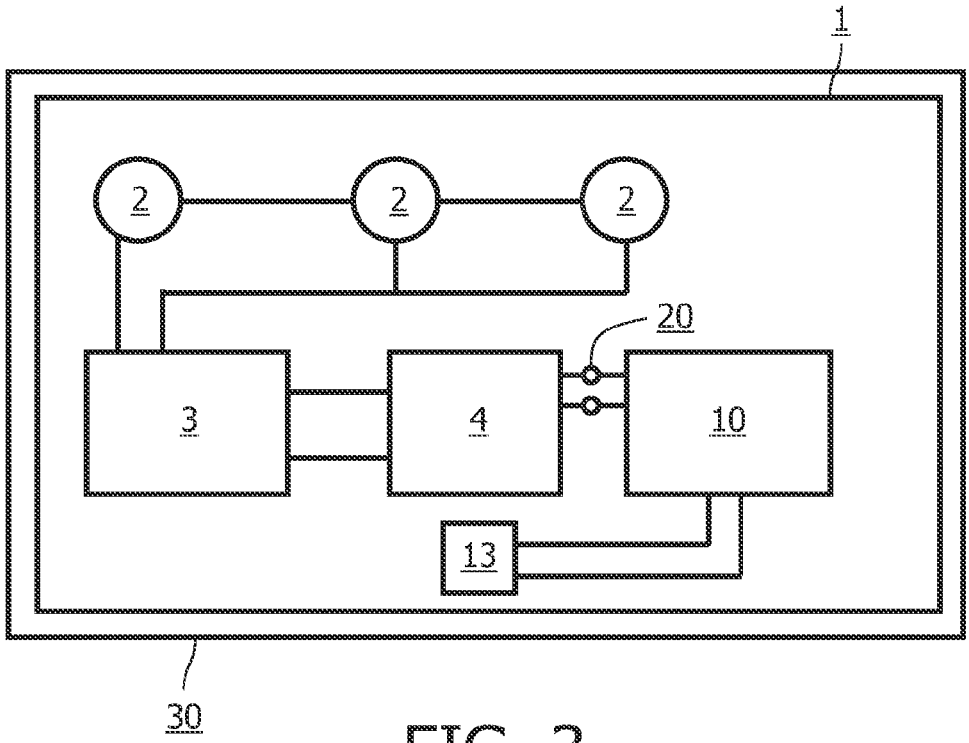
FIG. 3 shows a principal sketch of a second embodiment of a lighting system according to the invention.

In FIG. 3, a further embodiment according to the current invention is shown. In comparison with the embodiment shown in FIG. 1, three LEDs are parallel-connected to the control circuit 3. Further, a memory status sensor 13 is connected to the refresh circuit 10. The memory status sensor 13 is a temperature sensor (e.g. thermocouple, PT100 or a semiconductor based PTC) measuring the operation temperature of the memory device 4. The measurement data measured by means of the memory status sensor is transferred to the controller 11 of the refresh circuit 10, as depicted in FIG. 2. The controller calculates the time left until the data stored by means of the memory device has to restored by means of the refresh circuit 10, as described above, based on the measurement data measured by means of the memory status sensor 13 and the temperature dependence of the retention time of the memory device 4. The data stored by means of the memory device is restored by means of the refresh circuit 10 before any data loss can happen. In addition, the lighting system 1 is mounted on a heat-spreading device 30. The heat-spreading device 30 can either be a passive heat sink or a combination of a heat sink and e.g. an actively controlled fan. The fan can be controlled using the temperature measured by means of the memory status sensor 13. The temperature of the lighting system 1 is kept constant, guaranteeing a reliable operation with respect to the light output of the LEDs 2. Due to the fact that the memory device 4 can withstand high operation temperatures without data loss by means of the refresh circuit 10, the cooling effort can be low, thus reducing the costs of the lighting system 1.

Figure 4:
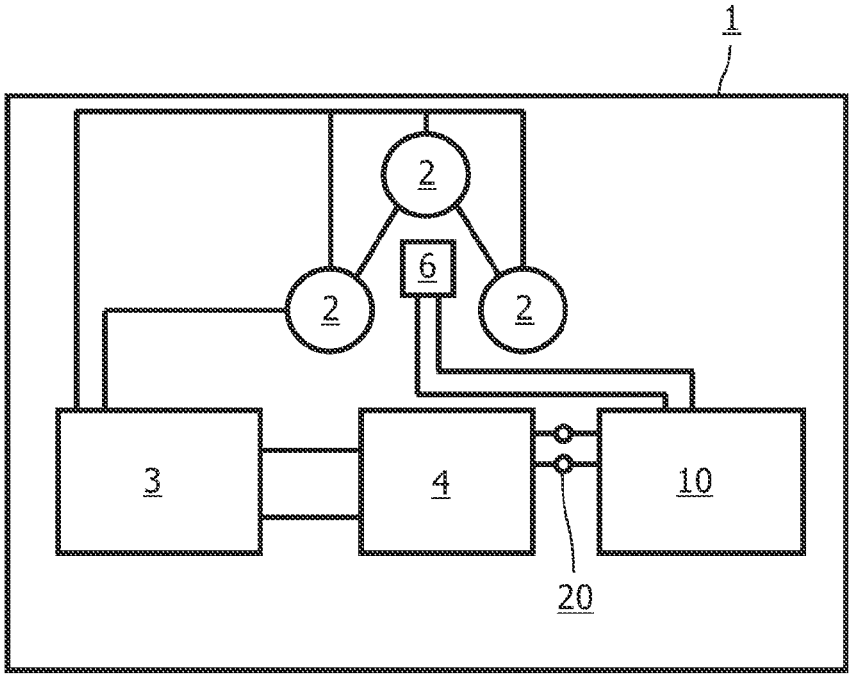
FIG. 4 shows a principal sketch of a third embodiment of a lighting system according to the invention.

In a further embodiment according to the current invention, the lighting system 1 comprises a light sensor 6 as depicted in FIG. 4. The light sensor 6 is surrounded by 3 colored LEDs 2, the LEDs 2 being arranged in a triangle shape. The LEDs 2 are a red LED 2, a blue LED 2 and a green LED 2, being parallel-connected to the control circuit. The light sensor 6 is a photocell being sensitive at the 3 different wavelengths emitted by the LEDs 2. If a time period t1 has lapsed, the refresh circuit 10 starts the restoring process of the data stored by means of memory device 4 as described above in connection with FIG. 1. As a difference to the restoring process described in connection with FIG. 1, the restoring process comprises the steps of:

- copying the data stored in the memory device 4 to the buffer memory 12
- starting calibration measurements of the LEDs 2 by means of the light sensor 6 at different power levels applied to the LEDs by means of the control circuit 3 (the starting signal may be given by the controller 11 of the refresh circuit 10)
- comparing the results of the calibration measurements with the calibration data (being part of the data stored by means of the memory device 4) copied to the buffer memory 12
- adapting the calibration data stored by means of the buffer memory 12 by means of the controller 11, using the measurement results of the calibration measurements
- overwriting the data stored by means of the memory device 4 with the adapted data stored in the buffer memory 12

The light sensor 6 enables to factor in e.g. aging of the LEDs 2 resulting in a changed light output of the lighting system 2. The adapted data stored in the memory device 4 compensates such aging effects and guarantees a reliable operation of the LED lighting device 1 throughout the lifetime of the LEDs 2. The time period t1 can in addition be adapted to the expected aging of the LEDs.

The present invention will be described with respect to particular embodiments and with reference to certain drawings, but this is not to be construed in a limiting sense, as the invention is limited only by the appended claims. Any reference signs in the claims shall not be construed as limiting the scope thereof. The drawings described are only schematic and are non-limiting. In the drawings, the size of some of the elements may be exaggerated and not drawn to scale for illustrative purposes. Where the term "comprising" is used in the present description and claims, it does not exclude other elements or steps. Where an indefinite or definite article is used when referring to a singular noun, e.g. "a" or "an", "the", this includes a plural of that noun unless specifically stated otherwise.

Furthermore, the terms first, second, third and the like in the description and in the claims are used for distinguishing between similar elements and not necessarily for describing a sequential or chronological order. It is to be understood that the terms so used are interchangeable under appropriate circumstances, and that the embodiments of the invention described herein are capable of operation in other sequences than described or illustrated herein.

Moreover, the terms top, bottom, first, second and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

Other variations of the disclosed embodiments can be understood and effected by those skilled in the art in practicing the claimed invention, from a study of the drawings, the disclosure, and the appended claims.

The invention claimed is:

1. A lighting system, comprising:

a light emitting device;

a control circuit comprising a memory device;

a refresh circuit configured to prevent data loss of the memory device; and a light sensor configured to measure a light output of the lighting system, wherein the refresh circuit is further configured to modify data saved in the memory device in dependence on the measurements of the light sensor.

2. The lighting system according to claim 1, wherein that the light emitting device is a light emitting diode (LED).

3. The lighting system according to claim 1, further comprising a memory status sensor, and the memory status sensor is adapted to trigger the refresh circuit in dependence on the status of the memory device.

4. The lighting system according to claim 1, further comprising a system status indicator, and the system status indicator is adapted to trigger the refresh circuit in dependence on the status of the lighting system.

5. The lighting system according to claim 1, wherein the light sensor is configured to trigger the refresh circuit in dependence on the measurements of the light sensor.

6. A method of driving a lighting system comprising at least one light emitting device, a control circuit with a memory device and a refresh circuit, the method comprising the steps of:

storing data in the memory device;

controlling the lighting system by means of the control circuit and refreshing the data stored by means of the memory device by means of the refresh circuit, and measuring a light output of the lighting system wherein the refresh circuit is further configured to modify data saved in the memory device in dependence on the measurements of the light sensor.

* * * * *